United States Patent [19]

Taylor et al.

[11] 4,451,710

[45] May 29, 1984

[54] PRECISELY STABILIZED PIEZOELECTRIC RECEIVER

[75] Inventors: Michael G. C. Taylor, Herentals; Marc H. L. Buerman, Deurne, both of Belgium

[73] Assignee: GTE Atea NV, Herentals, Belgium

[21] Appl. No.: 413,928

[22] Filed: Sep. 1, 1982

[51] Int. Cl.[3] ..... H04R 1/22

[52] U.S. Cl. ..... 179/110 A; 381/121; 310/315

[58] Field of Search ..... 179/110 A; 381/121, 381/120; 310/315, 371

[56] References Cited

U.S. PATENT DOCUMENTS

| | | | |
|---|---|---|---|
| 3,676,720 | 7/1972 | Libby | 310/315 |
| 3,999,147 | 12/1976 | Otto | 310/315 |
| 4,314,174 | 2/1982 | Wing | 310/315 |
| 4,393,373 | 7/1983 | Torii | 179/110 A |

FOREIGN PATENT DOCUMENTS

| | | | |
|---|---|---|---|
| 51832 | 5/1982 | European Pat. Off. | 179/110 A |
| 2629605 | 5/1978 | Fed. Rep. of Germany | 381/121 |
| 52-28313 | 3/1977 | Japan | 381/121 |

*Primary Examiner*—Harold I. Pitts
*Assistant Examiner*—L. C. Schroeder
*Attorney, Agent, or Firm*—Charles A. Doktycz; Robert J. Black

[57] ABSTRACT

An electrical to acoustic transducer utilizing the piezoelectric qualities of a polymer lamina and an arrangement including an amplifier and network to compensate for the polymer variability. This is accomplished by first providing two sets of electrodes on the surfaces of the polymer, a first set for driving the polymer and a second set for sensing the polymer electrical output and utilizing it via a compensating network operative to produce an output which is the square root of the products of inputs from the two sets of electrodes to precisely alter the amplifiers drive into the polymers first set to thereby maintain a desired constant acoustic output.

14 Claims, 5 Drawing Figures

PRECISELY STABILIZED PIEZOELECTRIC RECEIVER

CROSS-REFERENCES TO RELATED APPLICATIONS

Patent applications: Ser. No. 333,241 entitled "Mechanically Coupled Electrical Isolator", Ser. No. 333,242 entitled "Mechanically Coupled Electrical Isolator Including Output Stabilization" and Ser. No. 333,239 entitled "Mechanically Coupled Electrical Isolator Including Multi-Output Stabilization" each in the name of Michael G. C. Taylor, filed Dec. 21, 1981; Ser. No. 333,240 entitled "A Stabilized Piezoelectric Receiver" and Ser. No. 332,790 entitled "A Stabilized Piezoelectric Transmitter" each in the names of Michael G. C. Taylor and Marc H. L. Buerman also filed on Dec. 21, 1981, and Patent applications: Ser. No. 413,925 entitled "Mechanically Coupled Electrical Isolator Including Output Stabilization and Multiple-Inputs" in the name of Michael G. C. Taylor filed concurrently herewith on related subject matter and assigned to the same assignee as the present invention.

BACKGROUND OF THE INVENTION (1) Field of the Invention

This invention relates to an electrical to acoustic signal transducer and more particularly to such a transducer utilizing a piezoelectric polymer and having an arrangement for stabilizing the output.

(2) Description of the Prior Art

Polyvinylidene Flouride (PVDF or $PVF^2$) is a polymer which has excellent piezoelectric properties. Specially prepared, PVDF can be used to achieved electro-acoustic transducers as taught in U.S. Pat. No. 3,792,204 (Murayama, et al.).

The sensitivity of such transducers has been observed to vary over the range of temperature associated with human environments (see W. D. Cragg and N. W. Tester, "Telephone Transducers using Piezoelectric Polymer Foil", Electrical Communication, No. 52 1977) and these variations are repeatable provided that a certain maximum temperature is not exceeded. Above such a maximum the change to the sensitivity becomes irreversible and time dependent (see J. M. Powers, "Effects of Temperature on the Aging Rate of Piezoelectric Polymer", presented at the 94th meeting of the Acoustic Society of America, 1977).

The poling process, wherey the passive foil is rendered piezoelectric, is critical and does not lend itself to a repeatability of better than ±2 db as would be appropriate, for example, to massproduced transducers for telephony applications.

The inherent simplicity of transducers using piezoelectric polymer foils, such as PVDF, together with the relatively low cost of the material, suggest that inexpensive transducers could be produced; however, unless the problems of variable sensitivity—as a function of temperature, age and maufacturing process—are minimized, the potential of piezoelectric polymer foil is limited.

SUMMARY OF THE INVENTION

The present invention concerns a technique for the construction of an inexpensive piezoelectric polymer foil transducer with acceptably stable and defined characteristics.

Thus according to the present invention, there is provided an acoustic transducer composed of a piezoelectric film/diaphragm made of polyvinylidene fluoride, the whole periphery of the film being fixed. Disposed on each of the opposite faces of the film are two pairs of electrodes. A first overlapping pair of electrodes are connected to an input amplifier such that upon the application of a signal voltage to said amplifier the diaphragm is driven to produce corresponding vibration motion. A second overlapping pair of electrodes is connected to the amplifier via an active electronic compensating circuit to modify the amplifier response. Such a modification of the response results in an overall stabilization of the resultant transducer.

DESCRIPTION OF THE PREFERRED EMBODIMENT

Figure 1:
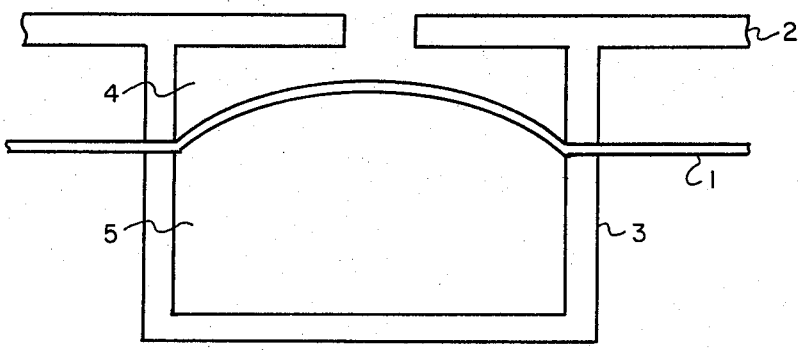
FIG. 1 is a sectional view of the transducer housing with the piezoelectric foil.

Referring to FIG. 1, 1 is the piezoelectric foil diaphragm, 2 is the front and 3 the rear housing of the transducer, 4 is a controlled caviy used to define the frequency response of the transducer, and 5 is a second controlled cavity which preferably should include a means for applying a static pressure to the foil so as to constrain that foil to assume a convex form in a manner as disclosed in U.S. Pat. No. 4,064,375 except that pressure rather than a vacuum could be used to achieve the convex curvature of the diaphragm. Either or both of the controlled cavities 4 and 5 shown in FIG. 1 may be implemented as multiple cavities to modify the frequency response of the receiver. U.S. Pat. No. 3,792,204 teaches the operation and construction of such a basic modification of a transducer as is shown in FIG. 1.

Figure 2:
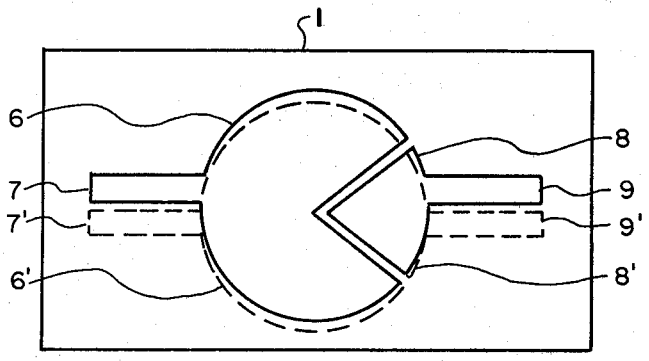
FIG. 2 is a plane view of the piezoelectric film and the relative placement of the conductive areas thereon.

This invention concerns the implementation of both a drive-element and a sense-element on the same foil diaphragm and the method of interconnecting it with an amplifier and active network such that the stability of the resultant transducer assembly is independent of the variation in piezoelectic properties of the foil. FIG. 2 shows an embodiment of the two pairs of active elements on the foil.

Referring to FIG. 2; 1 is the piezoelectric polymer foil diaphragm, 6 and 6' are similar areas of conducting material (for example, aluminum) which lie within the enclosed volumes of the transducer and constitute the drive-element, 7 and 7' are the connecting means giving access to the areas 6 and 6', 8 and 8' are similar areas of conducting material which lie within the enclosed volumes of the transducer and constitute the sense-element, and 9 and 9' are the connecting means giving access to areas 8 and 8'.

When a diaphragm of the form shown in FIG. 2 is used in the construction illustrated in FIG. 1 then the application of a voltage to the connecting means 7 and 7' will cause a strain in the foil due to the transducer action of the piezoelectic drive-element; this strain is mechanically coupled throughout the foil hence, a voltage will appear at the connecting means 9 and 9' due to the transducer action of the piezoelectric sense-element 8 and 8'. In addition to the direct mechanical coupling of strain between the two elements there is an acoustic coupling due to the cavities 4 and 5 of the transducer, being common to both elements.

Considering a reduction in the piezoelectric sensitivity of the foil by a quantity of N dB; then for a given voltage applied to the drive-element connecting means 7 and 7' the mechanical strain and the resultant sound pressure will also be reduced by N dB, as will the sensitivity of the sense-element, hence the overall reduction in voltage produced at the sense-element connecting means (9 and 9') is 2N dB.

By use of the voltage produced at the sense-element to modify the voltage applied to the drive-element it is possible to nullify the dependence of the transducer sensitivity on the piezoelectric sensitivity of the foil.

Figure 3:
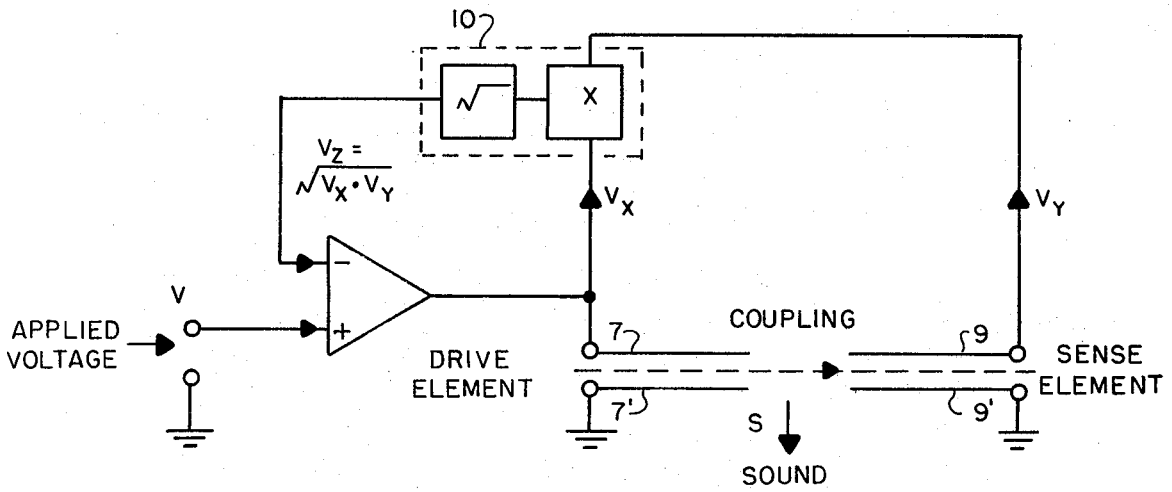
FIG. 3 is a circuit drawing showing how the conductive areas may be interconnected electrically.

FIG. 3 shows a means of implementing the feedback to stabilize a transducer used as a receiver (voltage-to-sound transducer). Also shown in FIG. 3 is an electronic means 10 whereby the voltages Vx and Vy may be combined to obtain an output voltage which is equal to Vx·Vy. An embodiment of such a means is shown in FIG. 4.

Figure 4:
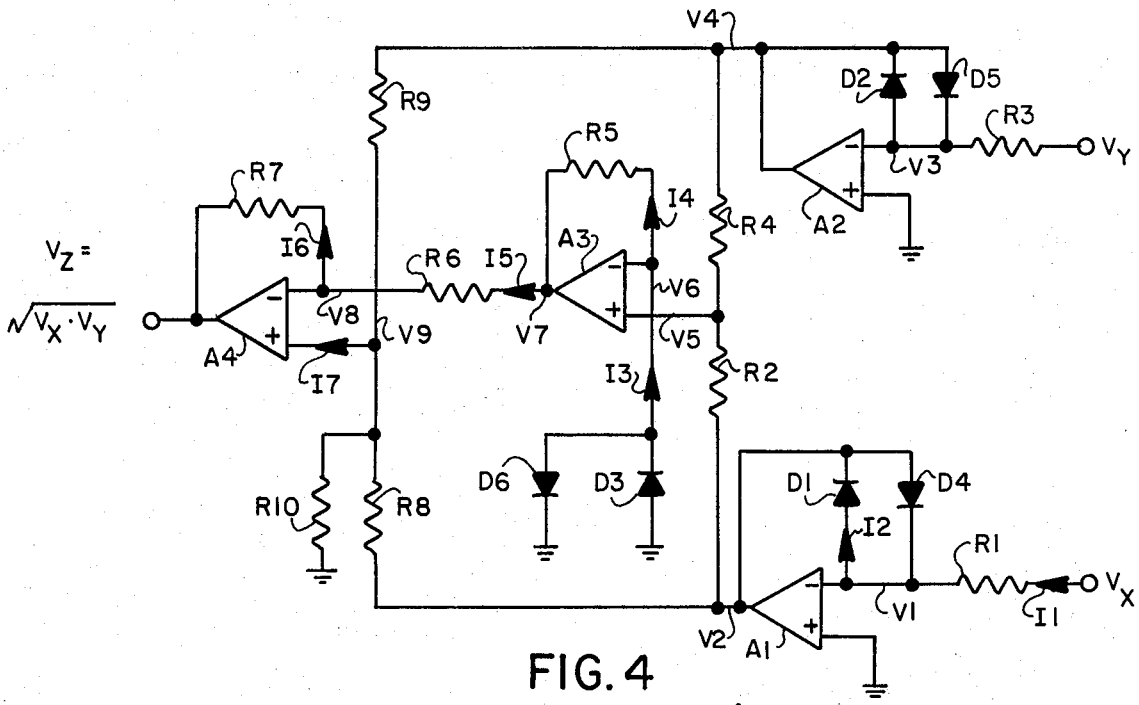
FIG. 4 is a circuit drawing showing an embodiment of the network used in FIG. 3.

Referring to FIG. 4, R1, R3 and R5 are identical resistors of value $^{R}$A; R2 and R4 are identical resistors of value $^{R}$B; R6 and R7 are identical resistors of value $^{R}$C; A1 thru A4 are identical operational amplifiers and D1 thru D6 are identical diodes which exhibit a preferred voltage-current relationship of V=K.LogI where K is a constant characterizing these diodes.

Considering the case when the input voltages Vx and Vy are each positive; from the operating conditions of operational amplifier A1 V1=0 hence $$I1 = I2 = \frac{Vx}{R_A} \text{ and}$$

$$V2 = -k \cdot \log \frac{Vx}{R_A},$$

similarly $$V4 = -K \cdot \mathrm{Log} \frac{Vy}{R_A}.$$

As $R2 = R4 = R_B$ $$V5 = \tfrac{1}{2}(V2 + V4)$$

$$= \tfrac{1}{2}\left(-K \cdot \mathrm{Log} \frac{Vx}{R_A} - K \cdot \mathrm{Log} \frac{Vy}{R_A}\right)$$

$$= -K \cdot \log \left(\frac{Vx}{R_A} \cdot \frac{Vy}{R_A}\right)^{\frac{1}{2}}$$

$$= -K \cdot \log \sqrt{\frac{Vx \cdot Vy}{R_A^2}}$$

$$= -K \cdot \log \left(\frac{1}{R_A} \cdot \sqrt{Vx \cdot Vy}\right)$$

From the operating conditions of operatioal amplifier A3 I4=I3 and V6=V5 hence

-continued $$I4 = 10\left(-\frac{1}{K}\left(-K \cdot \mathrm{Log}\left(\frac{1}{R_A} \cdot \sqrt{Vx \cdot Vy}\right)\right)\right)$$

$$= \frac{1}{R_A} \cdot \sqrt{Vx \cdot Vy}$$

and $$V7 = V6 - I4 \cdot R5$$

$$= V6 - \frac{1}{R_A} \cdot \sqrt{Vx \cdot Vy} \cdot R_A$$

$$= V5 - \sqrt{Vx \cdot Vy}$$

Considering the resistor network R8, R9, R10

$$V9 = R10\left(\frac{(V2 - V9)}{R8} + \frac{(V4 - V9)}{R9}\right)$$

if $2 \cdot R10 = R8 = R9$ then $$V9 = \frac{(V2 - V9)}{2} + \frac{(V4 - V9)}{2}$$

i.e.

$$V9 = \frac{V2 + V4}{4}$$

$$= \frac{V5}{2}$$

From the operating conditions of operational amplifier A4 V8=V9, I6=I5, I7=0 hence $$I5 = \frac{(V7 - V8)}{R6} = I6 = \frac{(V7 - V9)}{R7}$$

$$= \frac{\frac{(V7 - V5)}{2}}{R_C}$$

$$Vz = V9 - I6 \cdot R7$$

$$= \frac{V5}{2} - \frac{\frac{(V7 - V5)}{2} \cdot R_C}{R_C}$$

$$= V5 - V7$$

$$= V5 - (V5 - \sqrt{Vx \cdot Vy})$$

$$= \sqrt{Vx \cdot Vy}$$

Considering the case when Vx and Vy are each negative it can be shown that $Vz = -\sqrt{Vx \cdot Vy}$ hence the means of FIG. 4 achieves the condition that $$Vz = (\text{polarity of } Vx \text{ and } Vy) \cdot \sqrt{Vx \cdot VY}$$

It can be shown that by varying the values of R1 thru R5 relative to each other the sensitivity of the circuit means can be arranged to be appropriate for wide differences in magnitude between Vx and Vy yet still retain the required condition for Vz.

Referring to FIG. 3, the sound output S is related to the voltage Vx applied to the drive-element by some constant K1 (S=K1·Vx), the voltage Vy produced at the sense-element is related to the sound output S by some other constant K2 (Vy=K2·S), where K1 and K2 are functions of the physical construction and also of the piezoelectric properties of the foil.

To satisfy the operating conditions of the amplifier V=Vz, but $$Vz = \sqrt{Vx \cdot Vy}$$

hence $$V = \sqrt{Vx \cdot Vy} = \sqrt{\frac{S}{K1} \cdot K2 \cdot S} = S \cdot \sqrt{\frac{K2}{K1}}$$

and $$S = V \cdot \sqrt{\frac{K1}{K2}}$$

If K1 changes due to a change in the piezoelectric properties of the foil, K2 will also change proportionally, hence the term $\sqrt{K1/K2}$ is independent of changes in the piezoelectic properties of the foil. Hence, the transducer sensitivity (=S/V) is also independent of changes in those piezoelectric properties.

Figure 5:
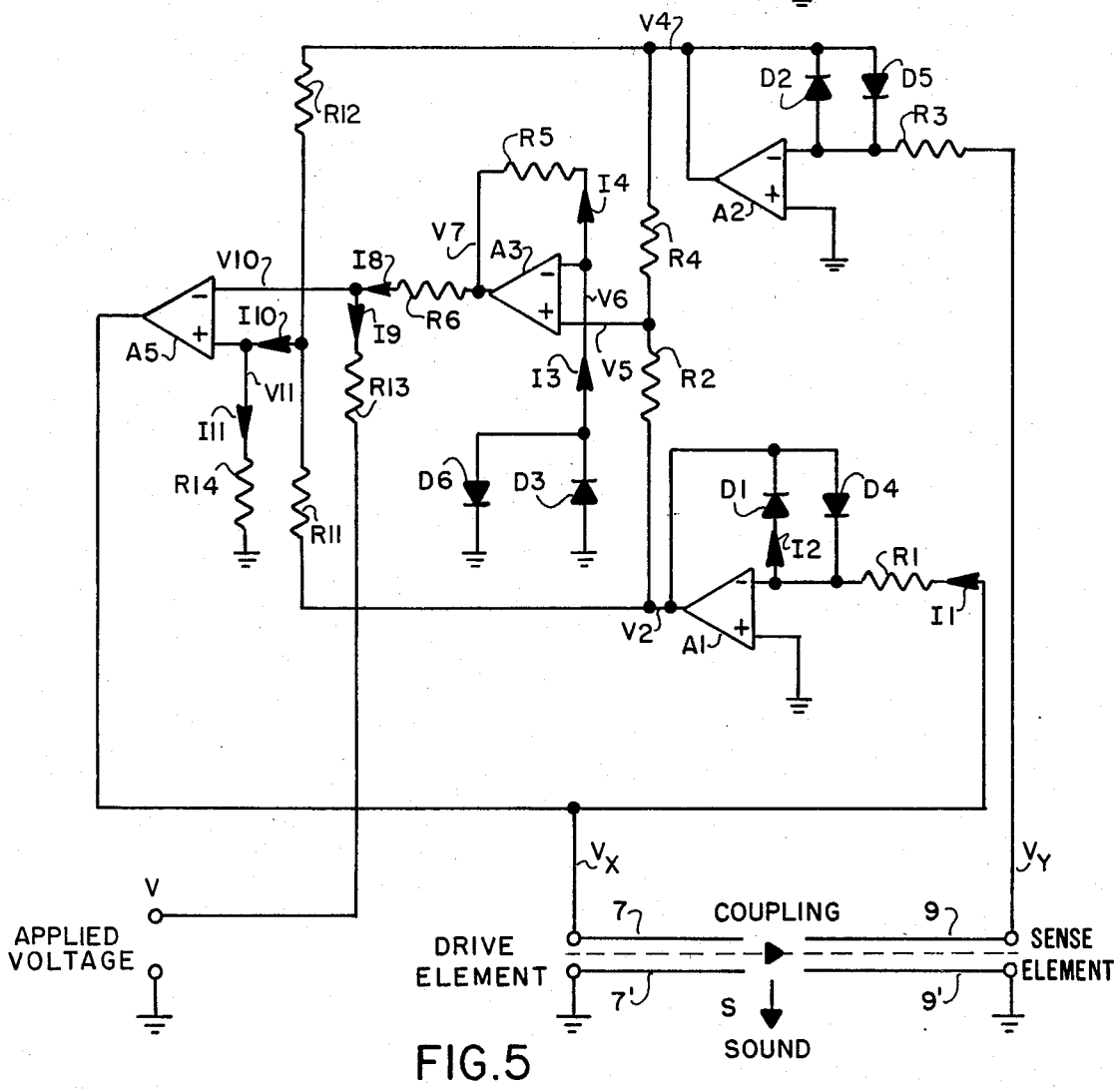
FIG. 5 is a circuit drawing showing how the network of FIG. 4 may be combined with the amplifier shown in FIG. 3.

The electronic means shown in FIG. 4 may be advantageously combined with the amplifier of FIG. 3 as shown in FIG. 5 where the operational amplifier A5 functionally replaces that of FIG. 3 and A4 of FIG. 4.

Referring to FIG. 5, from the operating concitions of operational amplifier A5 V10=V11, I8=I9, I10=I11 hence $$I8 = \frac{(V7 - V10)}{R6} = I9 = \frac{(V10 - V)}{R13}$$

and $$I10 = \frac{(V2 - V11)}{R11} + \frac{(V4 - V11)}{R12} = I11 = \frac{V11}{R14}$$

hence $$V10 = V11 = \left(\frac{V7}{R6} + \frac{V}{R13}\right) \cdot \frac{R6 \cdot R13}{(R6 + R13)}$$

and $$V11 = \left(\frac{V2}{R11} + \frac{V4}{R12}\right) \cdot \frac{R11 \cdot R12 \cdot R14}{(R12 \cdot R14 + R11 \cdot R14 + R11 \cdot R12)}$$

If $R13 = R6$ and $R11 = R12 = 2 \cdot R14$ then $$\frac{(V7 + V)}{2} = \frac{(V2 + V4)}{2} \cdot \frac{1}{2}$$

ie.

$$V = \frac{(V2 + V4)}{2} - V7$$

but $$V7 = V5 - \sqrt{Vx \cdot Vy}$$

and $$V5 = \frac{(V2 + V4)}{2}$$

therefore

-continued $$V = \sqrt{Vx \cdot Vy}$$

This is the same condition as must prevail in FIG. 3 to satisfy the operating conditions of the operational amplifier ie. $V=Vz=\sqrt{Vx \cdot Vy}$ hence the embodiment of FIG. 5 is seen to be equivalent to that of FIG. 3 plus the circuit means of FIG. 4.

What is claimed is:

1. In combination an electro-acoustic transducer comprising:
   - a vibratable diaphragm of a film polymer having piezoelectric properties;
   - a first pair of electrically conductive areas disposed on opposing overlapping surfaces of said film;
   - a second pair of electrically conductive areas disposed on opposing overlapping surfaces of said film, remote from said first pair of electrically conductive areas;
   - separate electrodes for each of said electrically conductive areas;
   - an amplifier including an inverting input, a non-inverting input and an output;
   - said amplifier output connected to said first pair of electrically conductive areas;
   - second means comprising an electronic network connecting said amplifier signal input to said electrodes of each said first and said second pair of electrically conductive areas and operated to output the square root of the product of the signals from said first and said second pair of electrically conductive areas with a polarity identical to that of the said signals;
   - said amplifier operated upon the application of an electrical signal at said non-inverting input to drive said first pair of electrically conductive areas to stimulate said diaphragm into a corresponding acoustic vibration; and
   - said second pair of electrically conductive areas operated to produce a corresponding electrical signal via said second means to control said amplifier output level.

2. In combination a piezoelectro-acoustic transducer comprising:
   - a vibratable diaphragm of a piezoelectric polymer having a first and a second pair of electrically conductive areas disposed on opposing overlapping surfaces of said diaphragm;
   - a driving amplifier including an inverting and a non-inverting input and an output;
   - said driving amplifier output connected to said first pair of electrically conductive areas;
   - said driving amplifier operated upon the application of an electrical signal to said non-inverting input for applying a corresponding electrical signal to said first pair of electrically conductive areas whereby said diaphragm is stimulated into a corresponding vibratile motion and acoustic output; and
   - analog circuit means connected to both said first and second pair of electrically conductive areas operated to produce an output to said driving amplifier inverting input which is equal to the square root of the product of the signals from said first and second pair of electrically conductive areas with a polarity identical to that of said signals, said driving amplifier controlled responsive to said output to said inverting input to thereby produce a desired acoustic output.

3. In a combination piezoelectro-acoustic transducer as claimed in claim 2, wherein said analog circuit means comprises:

a first and a second subcircuit each operated to convert a signal on said input to its corresponding logarithmic value on said output, each including an input and an output, said input of one of said pair connected to said first pair of conductive areas on said diaphragm, and said inputs of the other of said pair of subcircuits connected to said second pair of conductive areas of said diaphragm;

a third subcircuit having a first and a second input and an output, said inputs respectively connected to the outputs of said first and second subcircuits and operated to produce a signal at said output which is the logarithmic value of the square root of the product of said inputs;

a bias network;

a fourth subcircuit having a first and a second input and an output, said first input coupled to said output of said third subcircuit and said second input connected to said bias network, and operated to produce a signal in response to said inputs which is the square root of the product of said inputs.

4. In a combination piezoelectro-acoustic transducer as claimed in claim 3, wherein said first and second subcircuits each comprise an operational amplifier and a feedback circuit between said output and said inverting input.

5. In a combination piezoelectro-acoustic transducer as claimed in claim 4, wherein said feedback circuit comprises a series path with a pair of diodes in an inverse parallel connection.

6. In a combination piezoelectro-acoustic transducer as claimed in claim 5, wherein said diodes exhibit a voltage characteristic logarithmically related to the current flow therethrough.

7. In a combination piezoelectro-acoustic transducer as claimed in claim 3, wherein said third subcircuit comprises a series pair of resistors with said output at the midpoint between said resistors.

8. In a combination piezoelectro-acoustic transducer as claimed in claim 7, wherein said pair of resistors are of equal resistive value.

9. In a combination piezoelectro-acoustic transducer as claimed in claim 3, wherein said bias network comprises a pair of diodes in an inverse parallel connection.

10. In a combination piezoelectro-acoustic transducer as claimed in claim 9, wherein said diodes exhibit a voltage characteristic logarithmically related to the current flow therethrough.

11. In a combination piezoelectro-acoustic transducer as claimed in claim 3, wherein said fourth subcircuit comprises:

a third and a fourth operational amplifier each having an inverting and a non-inverting input and an output;

said third operational amplifier non-inverting input coupled to said output of said third subcircuit and said inverting input coupled to said bias circuit;

said fourth operational amplifier non-inverting input coupled to said bias circuit and said inverting input coupled to the output of said third operational amplifier; and said fourth operational amplifier output connected to said driving amplifier inverting input.

12. In a combination piezoelectro-acoustic transducer as claimed in claim 11, wherein both said third and fourth operational amplifiers include a feedback resistor from said respective outputs to said respective inverting inputs.

13. In a combination piezoelectro-acoustic transducer as claimed in claim 11 and including a resistor between said third operational amplifier output and said fourth operational amplifier non-inverting input.

14. In a combination piezoelectro-acoustic transducer as claimed in claim 3, wherein all of said operational amplifiers are of the same type.

* * * * *